United States Patent [19]

Weiner

[11] 4,135,285

[45] Jan. 23, 1979

[54] METHOD AND APPARATUS FOR ASSEMBLING SLIDE FASTENER SLIDERS

[76] Inventor: Lewis Weiner, 87-08 Santiago St., Holliswood, N.Y. 11423

[21] Appl. No.: 851,155

[22] Filed: Nov. 14, 1977

[51] Int. Cl.[2] ..... B29D 5/00

[52] U.S. Cl. ..... 29/409; 29/766; 29/707; 29/809

[58] Field of Search ..... 29/409, 766, 809, 34 A, 29/33.2

[56] References Cited

U.S. PATENT DOCUMENTS

| | | | |
|---|---|---|---|
| 2,354,690 | 8/1944 | Lawson | 29/768 |
| 2,693,217 | 11/1954 | Lange | 29/766 |
| 2,825,126 | 3/1958 | Legat et al. | 29/766 |
| 3,138,852 | 6/1964 | Mazura | 29/766 X |
| 3,234,635 | 2/1966 | Jakob | 29/766 X |

*Primary Examiner*—Victor A. Dipalma

*Attorney, Agent, or Firm*—Watson, Leavenworth, Kelton & Taggart

[57] ABSTRACT

A slide fastener slider is assembled from a stock of slider bodies, pull tabs and springs with apparatus which loads a body on an anvil at a loading station, moves the anvil to an assembly station and at the assembly station positions a pull tab to receive the lugs on the body therein, inserts a spring over the pull tab trunnion and between the lugs, the tip ends of the lugs thereafter being clenched to fixedly secure the spring to the body. The assembled slider is then ejected from the anvil to a collection point. In a further embodiment, the slider body instead of having lugs between which the spring is received and the tip ends of which are clenched to hold the spring, has lugs with recesses at the outer side surfaces thereof. The wing-like sides of the spring are inserted over the tip ends of such lugs with a spreading action until the spring sides snap into the recesses to secure the spring to the body.

39 Claims, 24 Drawing Figures

98
112
114
118
119
120
122
128
106
116
40c
108
134
110
126
132
123
125
124
88
140
142
12
92
100
101

90
6
112
112
116
148
148
98
40c
106
MICRO SWITCH
146
142
143
88
143
144
140
6

METHOD AND APPARATUS FOR ASSEMBLING SLIDE FASTENER SLIDERS

BACKGROUND OF THE INVENTION

Various methods and apparatus for assembling the sliders of slide fasteners are known. Exemplary of the same are those described in U.S. Pat. Nos. 2,711,574; 2,825,126; 2,838,969; 3,138,852 and 3,234,635. Such known methods and apparatus while satisfactory for the intended purposes do not provide optimized fool-proof operation as would prevent improper assembly of the slider components, possible damage to the assembly apparatus, etc. Moreover, known apparatus used for assembling sliders is of relatively complex construction having many machine components which require frequent maintenance and/or replacement.

The general objective of the present invention is to provide a new and novel method and apparatus to assemble automatically the various components thereof to form an automatic lock slider, to do so in a more efficient manner, and thereby provide an automatic lock slider of a better and more consistent quality than heretofore available.

Another object of the invention is to provide an assembly method and apparatus which embodies features therein, to detect the presence of faulty parts and/or the presence or absence of parts in the assembly operation and which function to stop the assembly operation in order to prevent the assembly of sliders which would lack springs or pull tabs.

Another object of the invention is to provide a novel method and apparatus which embodies features therein which function to protect the apparatus against damage as could be caused by operation of the same with faulty slider component parts.

Another object of the invention is to provide apparatus that with the exchange of few parts, can be utilized to assemble sliders of different size or sliders of different types.

Another object of the invention is to assemble sliders in line without employing costly and slow rotatable turret assembly equipment which involve effecting assembly operations at a number of stations, the advantage of the invention to thereby lessen the number of machine parts required and resulting maintenance of these parts.

Various other objects and advantages as well as novel features of this invention will become apparent from a reading of the detailed description which follows later.

SUMMARY OF THE INVENTION

The present invention is concerned with both a method and apparatus for assembling a slide fastener slider from the components of which such sliders are constituted. As those skilled in the art will appreciate, sliders can be provided as three component members, or they may be provided as four component assemblages. Moreover, certain variations can be provided in the overall assembly structure with regard to shape of the slider body, pull tab, etc. The present invention, however, is applicable to the assembly of sliders generally, although it will be described herein by way of example as being applicable to the assembly of a slider from three components, namely, a slider body, a pull tab and a spring. A particular embodiment of the invention to be described herein, relates to the assembling of a slider of the type described and depicted in U.S. Pat. No. 2,453,660.

In accordance with the present invention, a slider body from a suitable source thereof is fed by a feeder mechanism onto a slider body holder anvil at a body loading station in the apparatus. At the same time, a slider pull tab and a slider spring are fed to suitable holding means therefor disposed at an assembly station, suitable feeder means being employed for such purpose for conveying the pull tab and the spring to the assembly stations. The anvil carrying the slider body is then displaced from the loading station to present the slider body at the assembly station and in a positioning where the lugs on the front face of the slider body are caused to enter a slot in the pull tab following which, the spring is inserted between the lugs and in covering position over the trunnion or pivot piece of the pull tab. Thereupon, suitable clenching means are activated to clench over the tip ends of the slider body lugs against the spring and thereby to complete the assembly operation and securely fix the pull tab and spring to the slider body. Following the assembly, the anvil which forms part of a body holding means is retracted to return it to the loading station and the clenching means and spring loading means likewise are retracted to present them in position for a subsequent operating cycle.

In accordance with the invention, various means are provided to insure that the operation of the apparatus will not continue in the event any one of the sources providing the slider body, pull tab and spring become depleted to the extent that an improperly assembled slider would be produced by continued operation. Such means operate to detect the absence or presence of the various components not only in the in line feed stream in which they are fed to the respective loading and assembly stations, but also to detect the absence of a component at the assembly station itself so that the assembly operation would not be completed and cyclic operation of the machine continued to the detriment of the quality of the product produced by the apparatus. Components present in the apparatus which represent a faulty condition, for example, a slider body to which a spring has been inserted but which lacks the pull tab, are automatically rejected from the apparatus by suitable means embodied in the apparatus. Moreover, additional safety features provide that if a slider body is improperly mounted on the anvil, such fact is detected upon commencement of moving of the anvil from the loading to assembly stations and this causes the apparatus operation to cease so that means can be activated to eject the slider body from the anvil.

The apparatus also includes an assembled slider ejection means which operates during the time the anvil and its holder are being returned from the assembly to the loading station to remove the assembled slider from the anvil and deliver it to a collection container.

In another embodiment, the invention is concerned with the assembly of a slider in which the spring instead of being fixedly or captively connected with the slider body by clenching the tip ends of the slider body lugs over the spring main body part is so connected by reception of wing-like parts of the spring main body part in recesses formed in the outer side surfaces of the lugs, the spring wing-like parts being of inherently biased character such as to urge tightly against the lug recesses.

The invention accordingly comprises the features of construction, combination of elements, arrangement of parts and steps of assembly which will be exemplified in the construction and method herein set forth and the scope of the invention will be indicated in the claims.

BRIEF DESCRIPTION OF THE DRAWINGS

A fuller understanding of the nature and objects of the invention will be had from the following detailed description taken in conjunction with the accompanying drawings in which.

Throughout the following description, like numbers are used in the description to denote like parts in the drawings.

DESCRIPTION OF THE PREFERRED EMBODIMENT

Figure 1:
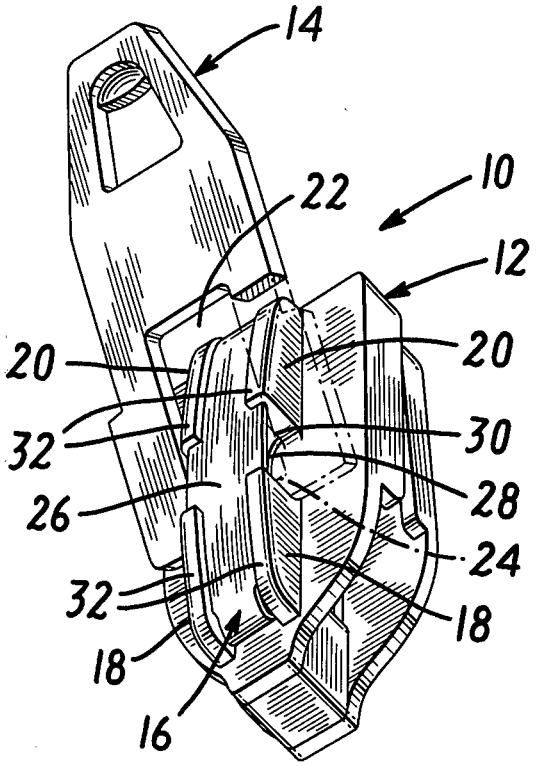
FIG. 1 is a perspective view on enlarged scale of a typical 3-part slider which can be assembled with the method and apparatus of the present invention.

The present invention is described herein by way of example as being applicable to a method and apparatus for assembling three-component lock sliders, but it should be understood that the principles disclosed herein are equally applicable to assembly of four-component sliders and to sliders of a wide range of constructions, the particular slider form depicted in FIG. 1 merely being exemplary of the types to which this invention pertains. FIG. 1, shows an assembled slider 10 which is comprised of a slider body 12, a pull tab 14 and a spring 16, such components being similar to those employed in the slider disclosed in U.S. Pat. No. 2,453,660, the slider being employed in a slide fastener in the manner and for the purposes set forth in said patent. The slider body 12 is provided, it will be noted, with upper and lower pairs of laterally spaced lugs 18, 20, respectively, such lugs being formed at a front or forward face of the slider body. Pull tab 14 has a slotted opening 22 formed therein and one boundary of which is defined by a pull tab trunnion or pivot part 24, the trunnion extending across the body front face but being held for pivoting captive movement on the body by spring 16. Spring 16 has a main body part 26 which is received over the trunnion 24 and also extends intermediate the lugs of each pair of such lugs in the manner shown, the respective lugs being staked or clenched over the spring main body part 26 as at 32 to retain the spring securely on the body, the spring main body part being lowered rearwardly at the top and bottom as is evident from FIG. 1. The spring also includes a rearwardly directed prong part 28 which extends through an opening in the body as at 30 and locates a tip end therein within the interior of body 12. In assembling the slider, the slider body is disposed so as to receive either its upper or lower pair of lugs in the opening 22 of the pull tab with the pivot part 24 spanning the space between the two lug pairs, spring 16 is inserted against the body over trunnion or pivot 24 and the extremities of the lugs are clenched over the spring main body part to prevent its withdrawal from the slider body, the assembled slider then being ejected from the assembly location to a collection container. Such assembly procedure is carried out on high speed continuous basis in the manner and with the apparatus of the invention to be described next.

Figure 2:
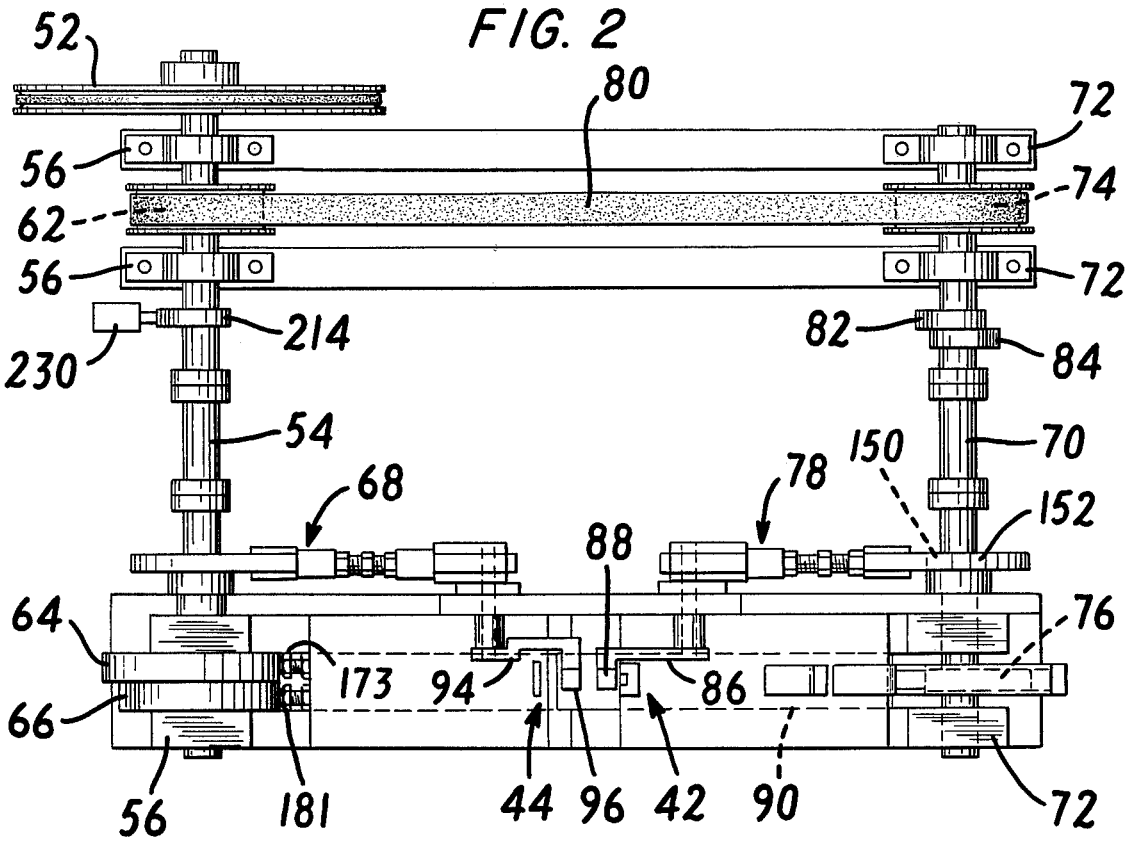
FIG. 2 is a plan view of the assembling apparatus of the present invention with the vibrating feeding bins and certain other components not being shown for sake of clarity of depiction.
Figure 4:
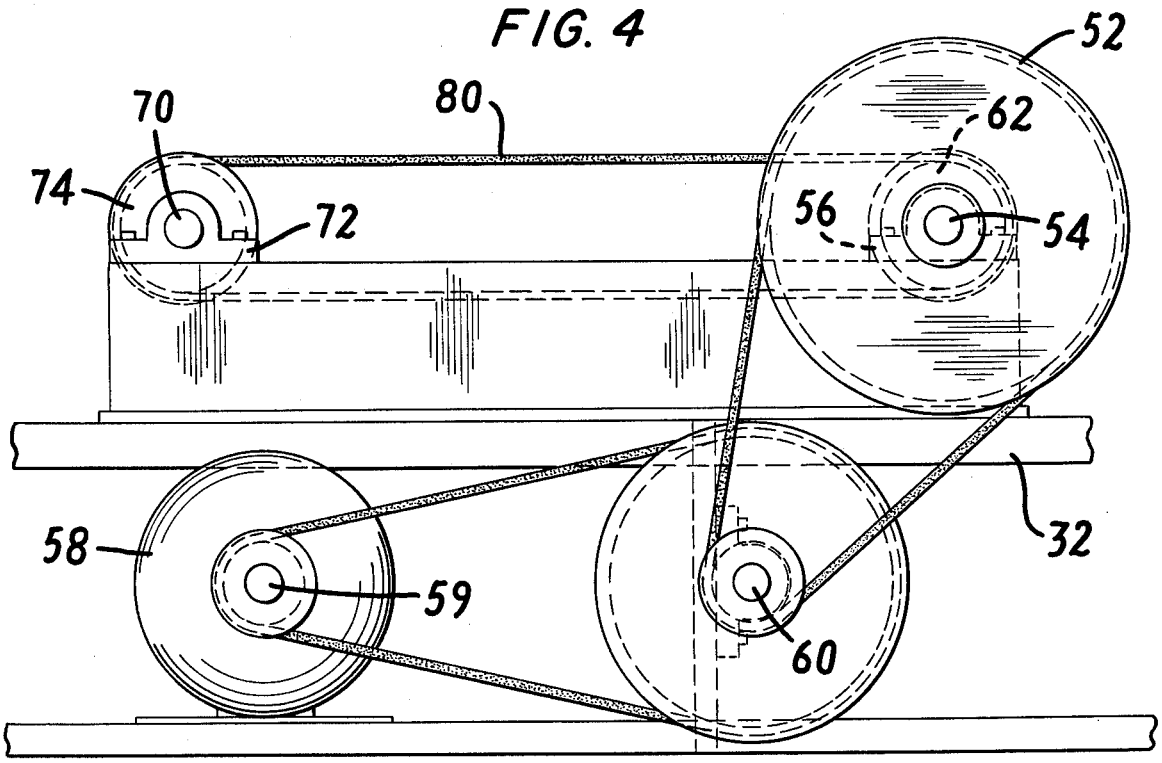
FIG. 4 is a rear elevation view of the apparatus illustrating the drive mechanism for operating the various apparatus components.
Figure 3:
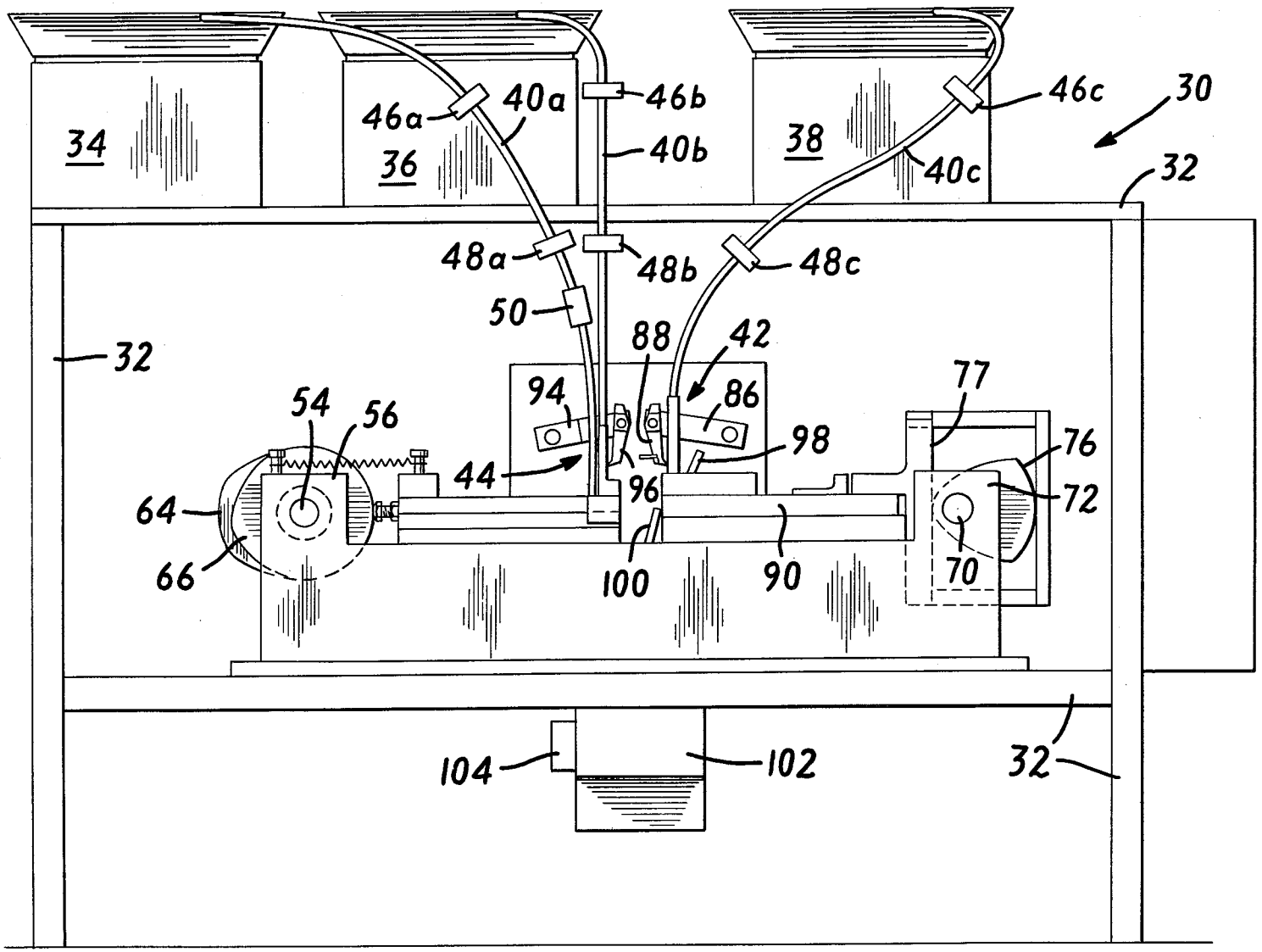
FIG. 3 is a front elevation view of the apparatus shown in FIG. 2.

With reference now to FIGS. 2–4, the apparatus 30 it will be noted is of generally compact character and readily can be installed at any one of a number of convenient locations in a shop or mill, occupying only an area measured about 3′ by 6′. The apparatus 30 includes suitable frame components 32 on which is mounted the various devices to be described later, the fabrication of such components to provide a frame being effected in any one of a number of known manners to effect the intended purpose. Located at the top of the frame structure are bins 34, 36, 38 in each of which are provided a stock of the components from which the sliders are assembled. Thus bin 34 contains springs 16, pin 36 pull tabs 14, and bin 38 slider bodies 12. The bins are designed to hold a stock of many thousands of the various slider components and are of known construction, being of the vibrating pot type which employ vibration of the bin to transport and properly orient the components for in-line feed travel in the assembly streams of such components. Connected to each respective bin are delivery chutes **40*a*, 40*b* and 40*c*, the chutes having upper entry ends where components enter from the bins and delivery courses which extend down to and terminate at either a loading station (shown generally at 42) or an assembly station (shown generally at 44) depending on the component involved. Associated with the delivery chutes are devices 46*a*, 46*b*, 46*c* respectively which function to control operation of bin vibration so that if the succession or stream of components in the chutes are present at or above the location of the said devices, the vibration of the associated bin is stopped and conversely if below such location to initiate vibration and hence feed from the bins to the chutes. The chutes also are provided with control devices 48*a*, 48*b*, 48*c* which function to stop operation of the apparatus if the stream level of components in the chutes falls below the location of such devices and thereby serving to signal that the bins need replenishment or a trouble condition exists in the system as is preventing proper feed of components to the assembly operation. Chute 40*a* also is provided with a control unit 50** which functions to feed or pass only one spring per assembly cycle of operation of the apparatus to a spring holder means at the assembly station. As will be better understood from description to appear later on, this is done to preclude the presence of more than one spring at or adjacent the spring holder since if same were to occur, the spring insertion means (to be described later) could during a particular cycle deform the next or several next up in the stream of springs so that such springs would not be suited for making sliders and would result in unserviceable or defectively assembled sliders.

Continuing with reference to FIGS. 2–4, the apparatus for effecting actual assembly of the components is powered from a single source such as an electric motor unit 58 which transmits drive from its output or main system shaft 59 through intermediate shaft 60 and suitable pulleys and belt members to a larger pulley member 52 which in turn is fixed to a shaft 54 rotatable in bearing member 56. Carried on shaft 54 and fixed therewith are a turning pulley 62, a pusher cam 64 and a clencher cam 66. Also mounted on shaft 54 is a motion producing drive unit (shown generally at 68) which is connected to a feed member for feeding pull tabs to the assembly station. A second shaft 70 is mounted in bearing supports 72 on the frame structure 32 and carries a timing pulley 74 over which traverses a timing belt 80, such timing belt also passing over timing pulley 62 and providing a synchronous or timed drive between shafts 54 and 70 for the purposes as will appear later. Shaft 70 also carries a cam 76 used to impart motion for moving a body holder means between the body loading station and the assembly station and vice-versa, cam 76 being in engagement with the cam follower surface 77 forming part of the structure connected to the body holder means, the shaft 70 also mounting a second motion producing drive unit shown generally at 78 and which is connected to a feed arm for feeding slider bodies to the holder means for mounting such slider bodies on an anvil forming part of the body holder means. Shaft 70 also carries two further cams 82, 84.

FIGS. 2 and 3 also depict a lever 86 to one end of which is mounted a feed arm 88 for feeding a slider body 12 from chute **40*c* onto the anvil 92 (FIG. 6) at the body loading station 42, the anvil being as noted part of a body holding means to be described in detail shortly and which has its position shifted leftwardly from the loading station position shown in FIG. 2 to present the body at the assembly station 44, the body holding means being connected to a ram 90 which is moveable in reciprocating straight line travel by the action of cam 76, the ram being guided by suitable members 112, 114. A similar lever 94 has a feed member 96 mounted to one end thereof and is employed at the assembly station 44 for feeding a pull tab 14 from chute 40*b* to the assembly station. It will be understood that in connection with the operation of the motion producing means 68 and 78 and the respective feed arm 88 and feed member 96 driven thereby, that the lower tip end of the feed arm and feed member enter the front of the chutes 40*b* and 40*c*, respectively, to engage the lowermost slider component in the stream therein and advance the said component to the respective body holding and pull tab holding means. In the event a slider body 12 should be improperly received and/or mounted on the anvil, and it should be understood that a slider body fed from chute 40*c* either fully and properly seats on the anvil or it is faultily mounted — there being no intermediate degree of proper mounting, means to be described shortly are provided for determing such improper mounting and also for stopping the operation of the apparatus and for removing the improperly mounted body member. As is seen in FIG. 3, a hand-actuated lever 98 is provided for actually effecting through the intermediary of a sliding plate to be discussed later, removal of the improperly mounted slider body. Also, during the course of normal cyclic operation of the apparatus, a fully assembled slider 10 is removed at the end of each assembly cycle by means of an ejection finger 100 (FIG. 3), the finished sliders being delivered by gravity to collection bin 102, there also being a rejects collection box 104**.

Figure 6:
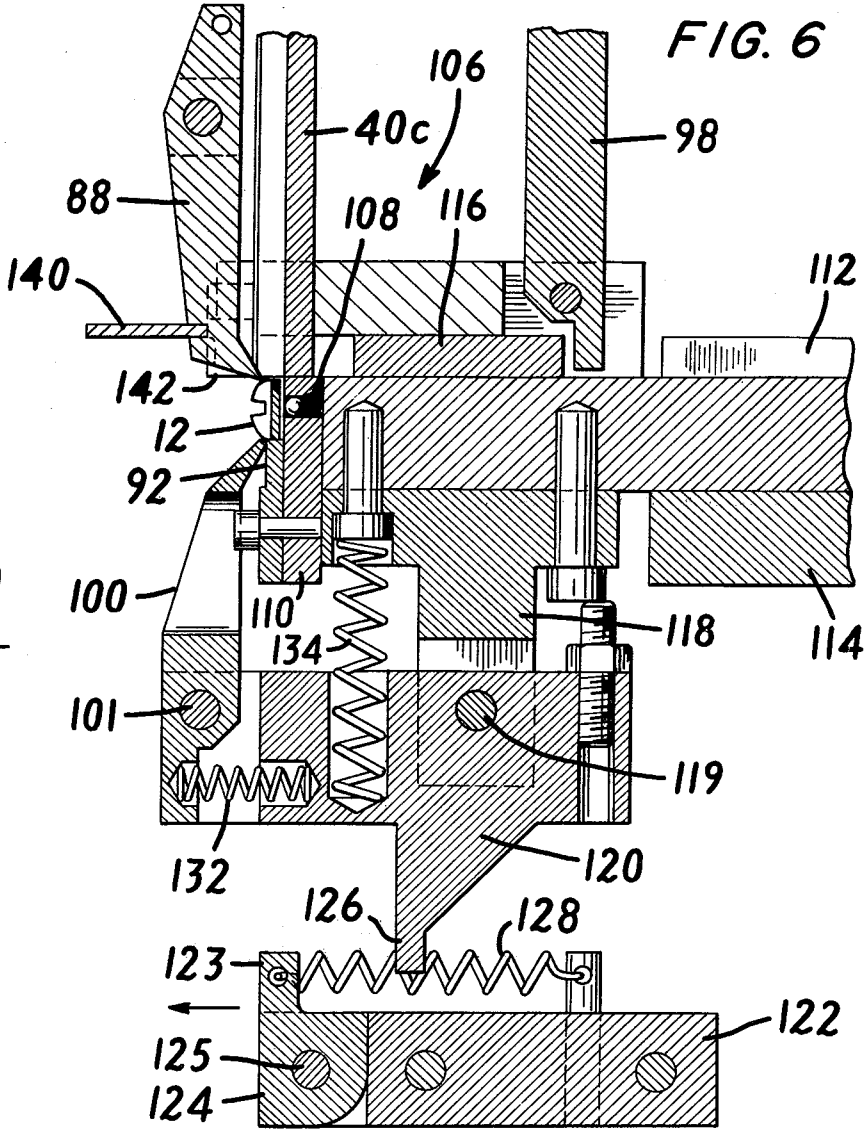
FIG. 6 is a fragmentary vertical cross-section of the apparatus shown in FIG. 5, depicting the body supply chute, body feeder mechanism and body ram unit which moves the anvil from the loading to the assembly station.
Figure 5:
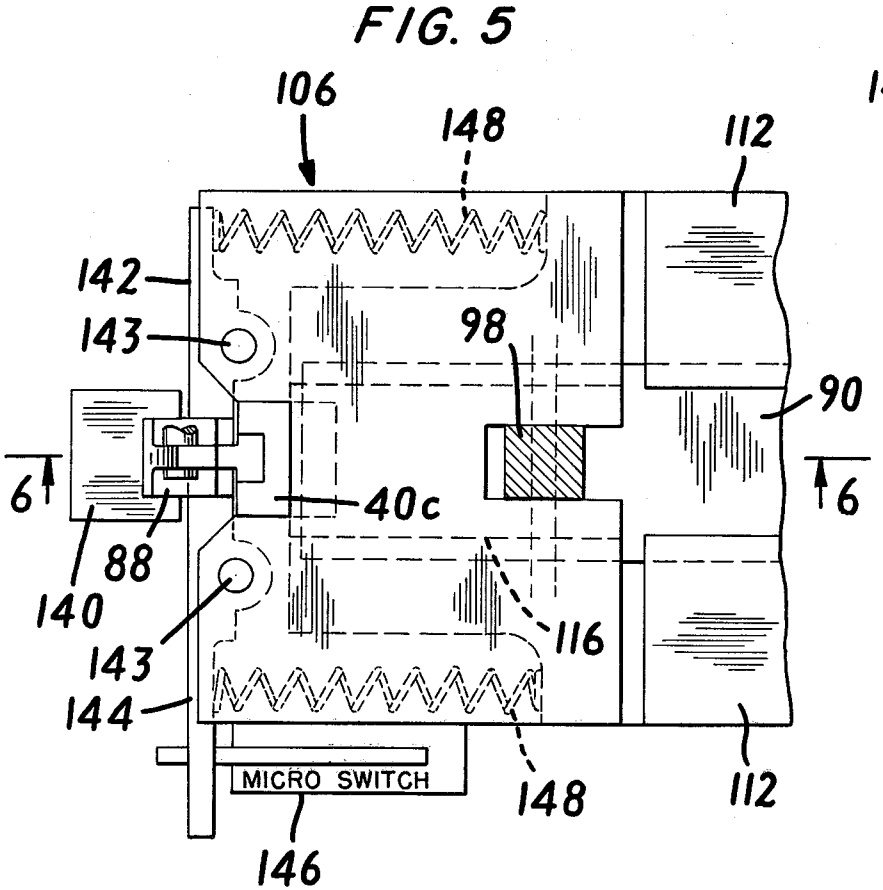
FIG. 5 is a fragmentary plan view on enlarged scale of the body loading station components including a protective device for stopping apparatus operation in the event a body is not completely or properly received on the body anvil, and a faultily mounted body removing mechanism which can be operated to remove such body from the anvil.

The various apparatus, components and devices at the loading station 42 will now be described in further detail with references to FIGS. 5 and 6. At the loading station, chute **40*c* extends downwardly to a terminal position in which it is disposed immediately above anvil 92 mounted on and comprising part of a body holding means shown generally at 106, the body holding means including a spring loaded ball member 108 which engages the rear of and maintains pressure against a body 12 mounted on the anvil to insure that its position does not alter in any fashion during the assembly operation. It will be understood that chute 40c extends down to a location wherein a body passing therefrom onto anvil 92 is fully clear of the chute. The anvil 92 is fixedly connected to a plate 110 which in turn is mounted at the forward end of ram member 90, the ram member being guided for reciprocating straight line travel in guiding members 112 and 114. Disposed above the ram and mounted for independent sliding movement relative thereto is a slide plate 116 which can be given sliding movement by engagement therewith of lever 98 to effect removal of an improperly mounted slider body. In FIG. 6, the feeding arm 88 is shown in a position in which it has just fed a slider body 12 onto the anvil 92. Also fixedly mounted on the ram 90 is a mounting block 118 to which is pivoted as at 119, an arm assembly 120 and connected to the forward end of the arm assembly is the generally or normally vertically disposed ejection finger 100 which is pivoted as at 101 to the arm assembly. Disposed below the arm assembly is a block 122 and at the front thereof, a stop abutment component 124 which includes a stop abutment projection 123. After a slider body has been received on the anvil 92 and at the appropriate moment in the operating cycle, the ram 90 is stroked leftwardly to position the slider body at the assembly station 44. During the course of such leftward travel of the ram, the arm assembly 120 also moves unitarily with the ram. However, an extension portion 126 at the lower part of the arm assembly strikes the projection 123 and the abutment yields to the movement of the arm assembly and the stop abutment component 124 is pivoted counter-clockwise about pivot 125 clear of the travel of the arm assembly, such action overcoming the force of tension spring 128 to permit rotation of the stop abutment component, the component 124 returning to the depicted position following the point the extension portion 126 has passed leftwardly beyond projection 123. Similarly, the ejection finger 100 is shifted in a leftward direction but, however, the same remains in a generally vertical position due to the action of compression spring 132. The compression spring 134 is used to maintain the arm assembly in the generally horizontally disposed position as shown during the leftward stroke of the ram member. Upon the retraction of the ram following the completion of assembly of a slider, the extension piece 126 on the arm assembly will strike the left side of projection 123 and since abutment 124 cannot rotate clockwise, this will cause the arm assembly 120 to rotate in a clockwise direction in turn moving ejection finger 100 upwardly where the said ejection finger is caused to engage the underside of the assembled slider and eject it from the anvil, the ejected assembled slider being thrown upwardly against a deflection plate 140 mounted at the lower end of feed arm 88**.

In the event a slider body is improperly mounted on the anvil 92, immediately upon commencement of the leftward travel of the ram 90, the improperly mounted body, which will extend above the upper surface of the ram since a properly mounted body will be at or below such surface, will during such leftward travel of the ram, engage a pair of plates 142 and 144 mounted for pivoting movement about vertical axes as at 143 and best seen in FIG. 5 so that rotation of at least one of the levers 144 which is connected with a microswitch unit 146 will actuate the switch to deenergize the power drive to the apparatus, for example, it will be used to stop motor 58. Concurrently, suitable signal means can be provided to indicate to the operator that the apparatus has been stopped by reason of a defect in the mounting of the slider body and the operator thereupon can operate lever 98 to slidably move plate 116 leftwardly so that it will engage the plates 142 and 144 to swing them clear of the loading station so that the operator is provided with access to remove the body from the anvil 92. The plates 142 and 144 which are part of the faulty body mounting detection system as will be noted best in FIG. 5 are maintained in a position in which there longitudinal axes are disposed substantially transversely of the direction of ram travel, such orientation being maintained by means of compression springs 148.

Figure 18:
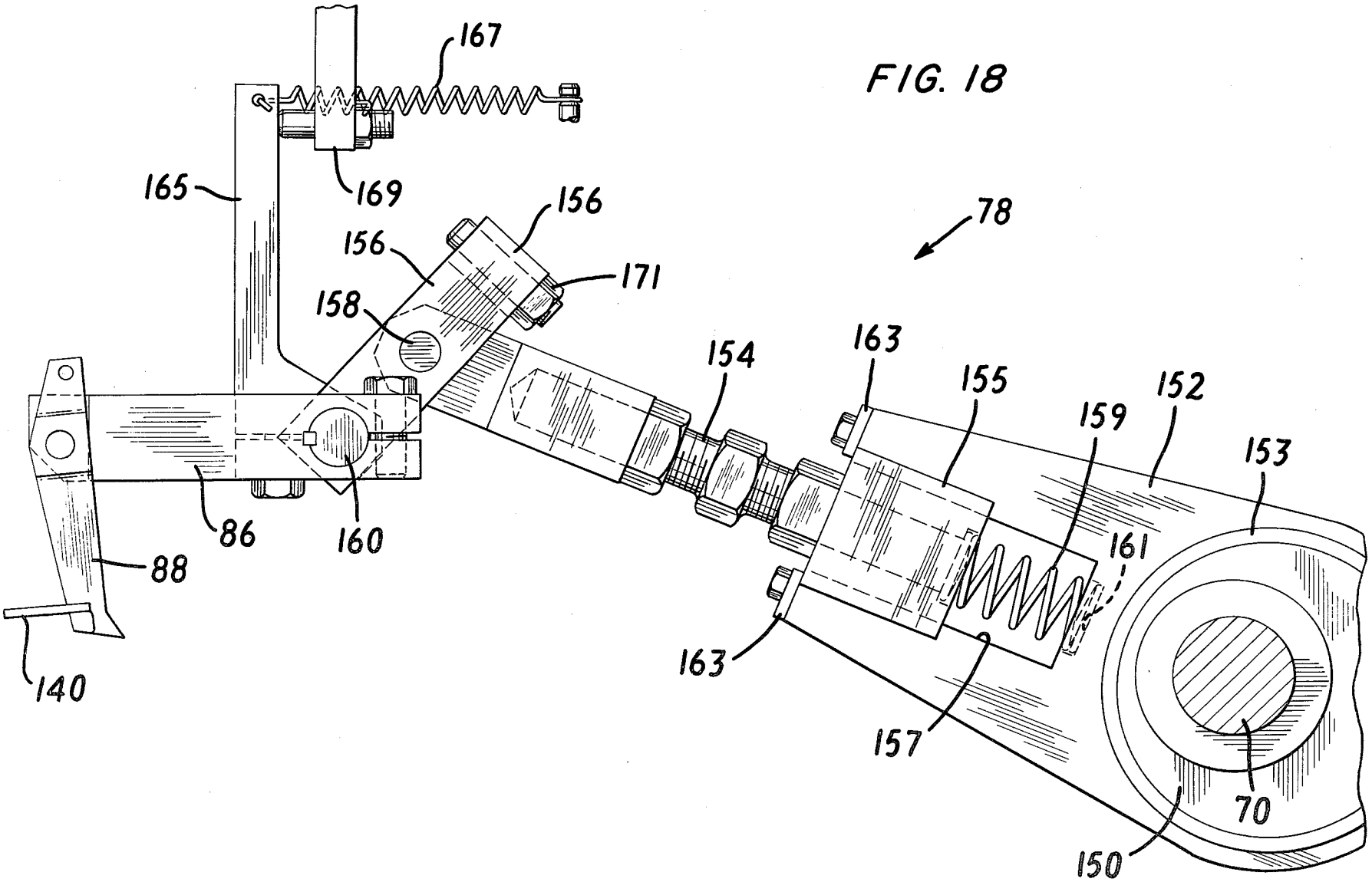
FIG. 18 is a side elevational view of the motion producing means for feeding a slider body to the loading station, the means used for feeding a pull tab to the assembly station being of generally similar construction.

With reference to FIG. 18, the operation of the motion producing means associated with the feeding arm and feeding members with which slider bodies and pull tabs are fed to their respective holding means can be best seen. Such motion producing means includes an eccentric 150 carried on shaft 70, a throw arm 152 connected to the eccentric and fitted with a bushing 153 in which the eccentric rotates, a pusher member 154 which is comprised of left and right hand screw members is connected to a block 155 which is slidably mounted in slot 157 formed in arm 152 and maintained under bias by spring 159 received in a socket 161 in the hub part of the arm, the forward travel of block 155 in slot 157 being limited by plates 163. Rotatably or loosely connected to the upper end of shaft 154 by means of a pivot 158 is an arm 156 and a further pivot 160 carried rotatably at the lower end of arm 156 to which is fixed feed arm 86 associated with the feeding of slider bodies. Also fixed to pivot 160 is a further arm 165, such arm 165 being connected to the pivot at its lower end, and its upper end being connected to a tension spring 167. A stop unit 169 is provided to be engaged by the upper end of the arm 165 during operation of the motion producer to limit the return travel of arm 165. As the eccentric 150 rotates, the shaft 154 moves arm 156 and the pusher screw 171 at its upper end engages and causes arm 165 and lever 86 to rotate counterclockwise. Hence feed arm 88 and particularly its tip end is given an oscilatory motion which during the feeding operation causes the feeding of a slider body from the body supply chute to the anvil following which the feeder arm is caused to retract upwardly and to the right in consequence of the oscilatory motion of the motion producing means. The motion producing means 78 associated with the mounting of a slider body on the anvil is designed to operate at a faster forward throw than that 68 associated with feeding the pull tab, since there is less time available in the operating cycle to affect slider body mounting than the pull tab insertion into its associated holder. During the retraction movement of the motion producing means 78, the arm 165 engages stop unit 169 to prevent further movement of same and thus position it for the next body loading operation.

Block 155 to which shaft 154 is connected, and spring 159 function as a safety device for the motion producing means so that in the event the feeder arm 88 should strike an obstruction during the operating cycle, the shaft and components connected therewith can retract against the spring to absorb the force of impact with the obstruction and prevent damage to the components.

Figure 7:
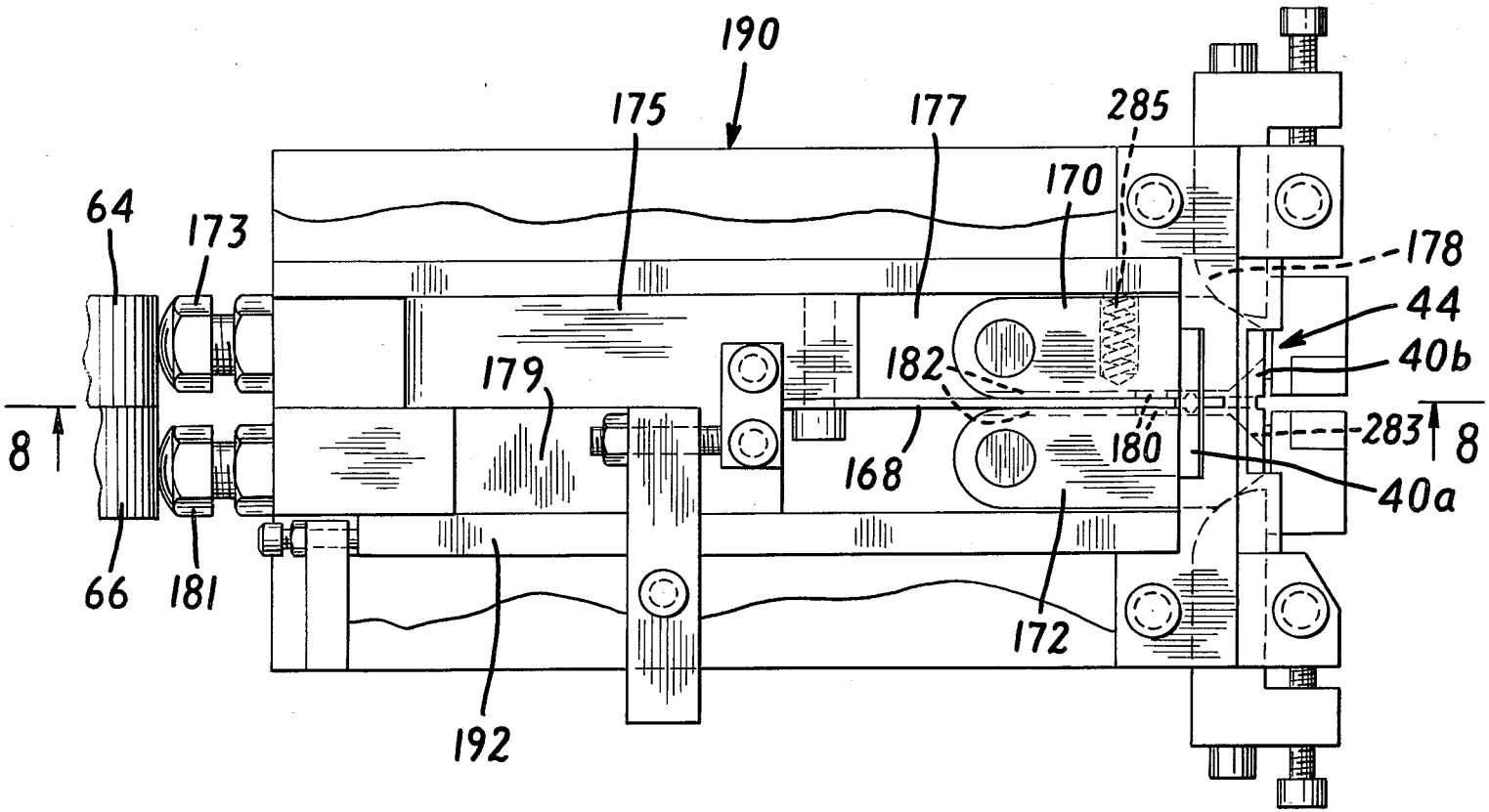
FIG. 7 is a top plan view of the assembly station components including a spring pusher for inserting the spring into the slider body prior to clenching, the clencher plates which clench or upset the body lugs to fix the spring in assembly with the body.
Figure 8:
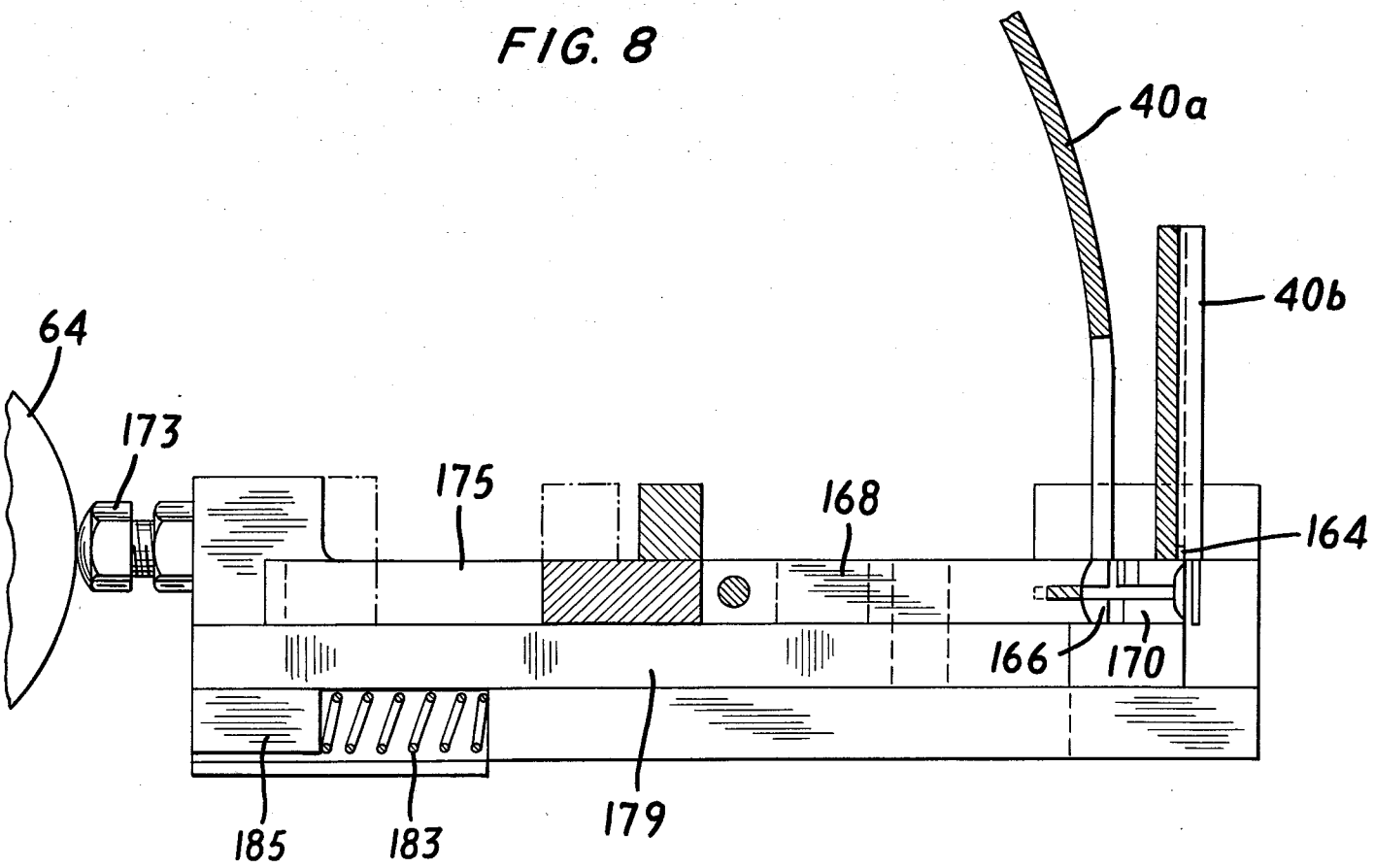
FIG. 8 is a vertical sectional view of FIG. 7.
Figure 9:
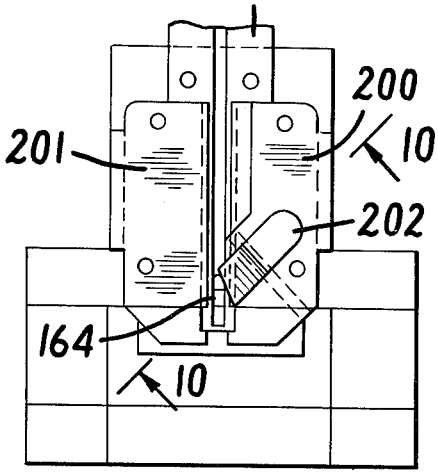
FIG. 9 is an elevational view of the pull tab holder unit and a device associated therewith to signal pull tab presence or absence in the holder.
Figure 10:
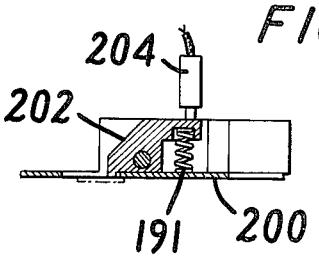
FIG. 10 is a sectional view taken along the lines 10—10 in FIG. 9, showing a lever for holding a pull tab in position for assembly at the assembly station, and a micro switch which is normally in open condition in the presence of a pull tab and which is closed in absence of a pull tab such micro switch functioning to operate controlling devices for shutting down the apparatus if a pull tab is not present at the assembly station.
Figure 11:
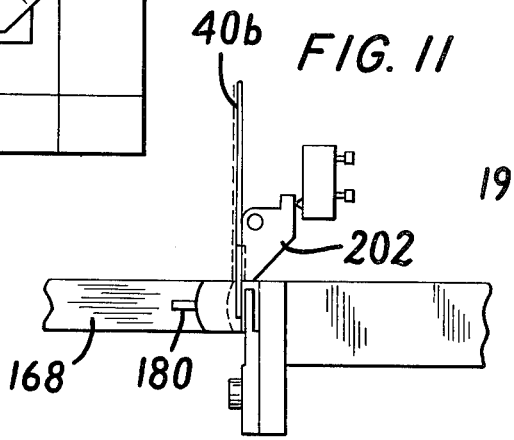
FIG. 11 is a schematic depiction of a body and a pull tab at the assembly station before the insertion of the spring therein by the spring pusher.
Figure 12:
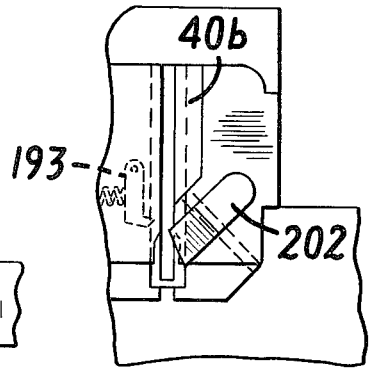
FIG. 12 is a front elevational view of FIG. 11.
Figure 19:
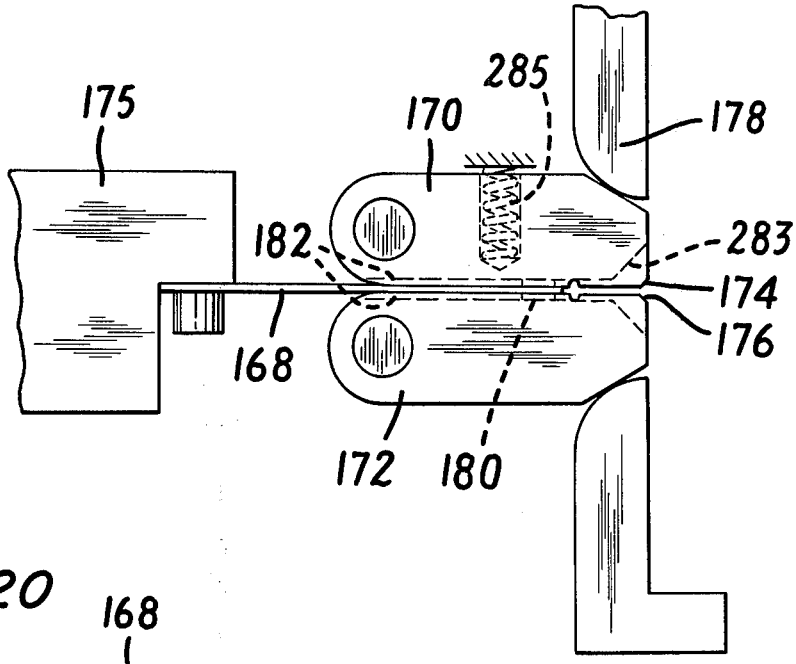
FIG. 19 is a fragmentary plan view of the clencher plates and spring pusher depicting further constructional details of each.
Figure 20:
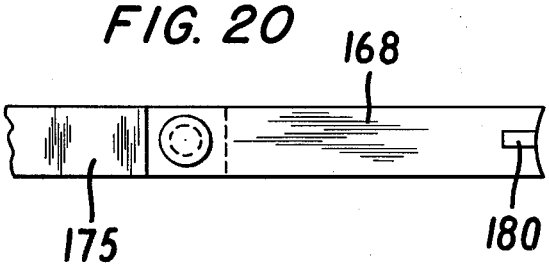
FIG. 20 is a side elevational view of the spring pusher.

With reference now to FIGS. 7, 8, 19 and 20, description will be given of the pull tab holder means, the spring holder and the various other devices associated with the assembly station 44 part of the apparatus. As seen in FIGS. 7 and 8, the chutes 40*b* and 40*a* associated respectively with the feeding of pull tabs and springs extend downwardly to the assembly station and the pull tab holder structure 164 including the lower end of chute 40*b* into which the lowermost pull tab in a stream is fed by feeding member 96 (FIG. 3) maintains the pull tab in an upright position and so disposed that when the body holding means is stroked leftwardly, the upper pair of lugs 18 of the slider body are received in the slot 22 in such pull tab. When a spring member 16 is released by the spring passing device 50 (FIG. 3) and falls downwardly through chute 40*a* it is received at a spring holding station 166 and following arrival of the body holding means at the assembly station and reception of the slider body in the pull tab, a spring insertion or pusher means 168 (FIG. 20) is stroked rightwardly to engage the spring and insert it intermediate the pairs of lugs on the slider body and in covering position over the trunnion 24 of the pull tab. This motion of the pusher inserter is effected by means of the pusher cam 64 (FIG. 3) which engages cam follower 173 (FIG.7) connected to a slidably supported block assembly 175 including a member 177 to which is fixed the rear end of the pusher means and indicated earlier, is operated in suitable timed sequence with the operation of the body holder means. Thereupon, a pair of clenching plates 170 and 172 which are mounted for pivoting about vertical axes on a sliding plate 179 and which are disposed in parallel spaced alignment one with the other are stroked rightwardly by effect of cam 66 engaged with cam follower 181 connected to plate 179, a short distance in a clenching stroke to bring the clenching chamffered juxtaposed corners 174 and 176 of the plates into contact against the extremities of the lugs to clench or stake them over the spring. To insure that no lateral spread occurs in the clenching plates 170 and 172 during the rightward stroking thereof, a camming block 178 is mounted adjacent the assembly station and clenching plate 170 strikes same to maintain it in at least parallel relationship with plate 172 although a slight movement toward each other is preferred as this provides optimized clenching action, a similar camming block is provided for the other plate 172. Springs 285 (FIG. 19) also act on the clencher plates to enhance the clenching operation by acting to urge the plates toward each other. Both the sliding plate 179 and the block assembly 175 are spring loaded in a manner as tends to bias them leftwardly in opposition to the effect of cams 64 and 66, (FIG. 3), as e.g., by spring member 183 connected with a bottom extension 185 of sliding plate 179. The structure of the pusher 168 or spring insertion member is such that the forward end thereof is provided with wing tabs 180 thereby to provide it with conformity to the shape of the main body portion of the spring 16. These wing tab portions are received in and slide in suitable slotted grooves 182 formed in the clencher plates. Furthermore and as seen in FIG. 19, the clencher plates have oblique widened slots 283 into which the wing tabs 180 pass during clenching to provide clearance for allowing the clencher plates to move toward each other.

Upon completion of the assembly of the slider, the clencher plates are retracted leftwardly as is the spring pusher member to present them in a position for a new cycle of operation. Both the spring inserter or pusher and the clencher plates are mounted on suitable structure as at 190 to insure that the same traverse reciprocating straight line travel in the assembly operation.

Figure 13:
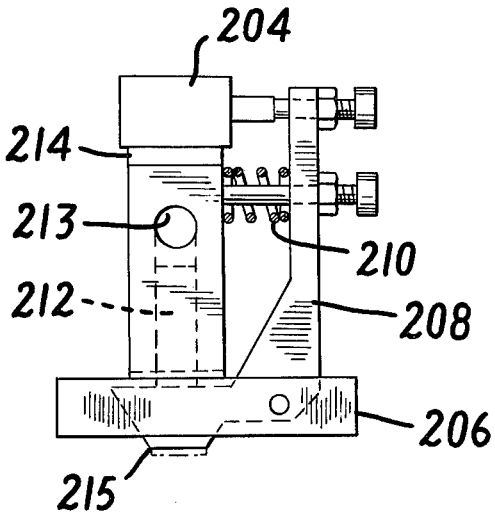
FIG. 13 is an elevational view of a control switch operating touching device which is used to detect the presence or the absence of parts in a feed chute.
Figure 14:
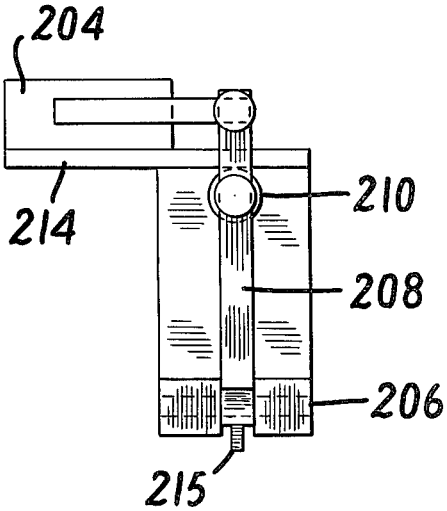
FIG. 14 is a side view of the touching device shown in FIG. 13.

With reference to FIGS. 9–12, these depict the structure at the assembly station and used for maintaining the pull tab 14 in its associated holder 164 and a lever 193 which holds the next succeeding pull tab 14 up in the stream during the assembly operation. As will be noted, the chute 40*b* for the pull tabs includes at the front side thereof a pair of plates 200, 201 which function to retain the pull tabs properly within the chute and in the chute holder means the plate 200 also mounting a lever 202, lever 202 which serves to engage with and maintain the lowermost pull tab in its associated holder and assembly position also functions to detect the absence or presence of the pull tab at the assembly station. If a pull tab were not present at the assembly station so that the assembly cycle if carried out would result in defective assembly, the lever 202 which is spring loaded and maintained in a first position by the presence of a pull tab, will be caused to pivot against the microswitch 204 by action of spring 191 and thereby deenergize power to the motor 58 since the switch 204 is connected in circuit with the power circuitry of the apparatus to produce such effect. Each chute is provided with detecting devices to determine presence or absence of component parts. A more particularized description of the features of these detecting devices or switches which touch the components in the chutes to determine presence or absence thereof are shown in FIGS. 13 and 14. The touching switch has a body 206 in which is pivoted a lever 208 which in turn is spring loaded by spring 210, working against plunger 212. Pressurized air controlled by operation of cam 214 (FIG. 2) enters passage 213 and functions to depress the plunger 212 and lever 208. The bottom of lever 208 touches a part, e.g., a pull tab 14 as at 215 if present, and does not activate the microswitch 204. If the slider part is absent, the lever pivots downwardly to a greater degree and activates the microswitch which in turn is connected with apparatus circuitry to stop the apparatus. A plate 214 mounts the microswitch at the lever assembly. The air supply and electric signal employed in operating the detecting unit are generated independently from the apparatus whether it is running or not with the air signal having approximately twice the length of time as the electric signal. In case a part is missing under the touching switch (devices 48*a*, 48*b* and 48*c*), the lever finds no resistance, the microswitch 204 is activated and the signal stops the machine and lights a signal lamp to indicate which chute is empty. In the case of a touching switch (devices 46*a*, 46*b* and 46*c*), if the chute is full, the microswitch is activated and the signal stops the vibration of the respective bin. If the parts are used up by the machine, the microswitch generates a different signal which starts the electric hopper. Such touching switches eliminate costly and unreliable electric eyes and air switches as heretofore used.

Figure 15:
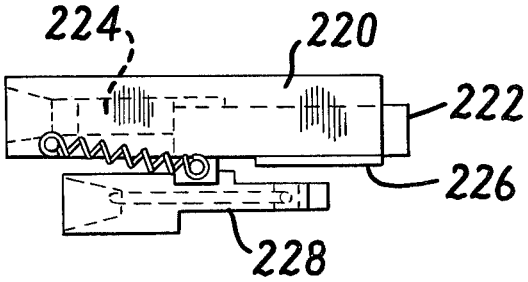
FIG. 15 is a plan view of a device mounted on the lower part of the spring supply chute which operates to pass only one spring into the assembly station, per cycle of apparatus assembly operation.
Figure 16:
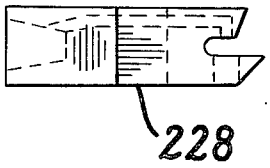
FIG. 16 is a side view of FIG. 15.

FIGS. 15 and 16 depict a release located in mechanism 50 for releasing a slider spring from chute 40*a* one spring per cycle of apparatus operation into the spring holder. Such mechanism 50 includes a body 220, a plate 222 slidably mounted in the body, a plunger 224 moved by a timed air pulse, a retaining plate 226 and a spring loaded sliding plate 228 which holds the in-line stream of springs and releases them one at a time when it is actuated by plunger 224. A timed air blast speeds up the travel of the spring. Intermittant air supply is provided and controlled by cam operating air valve 230 (FIG. 2).

Figure 17:
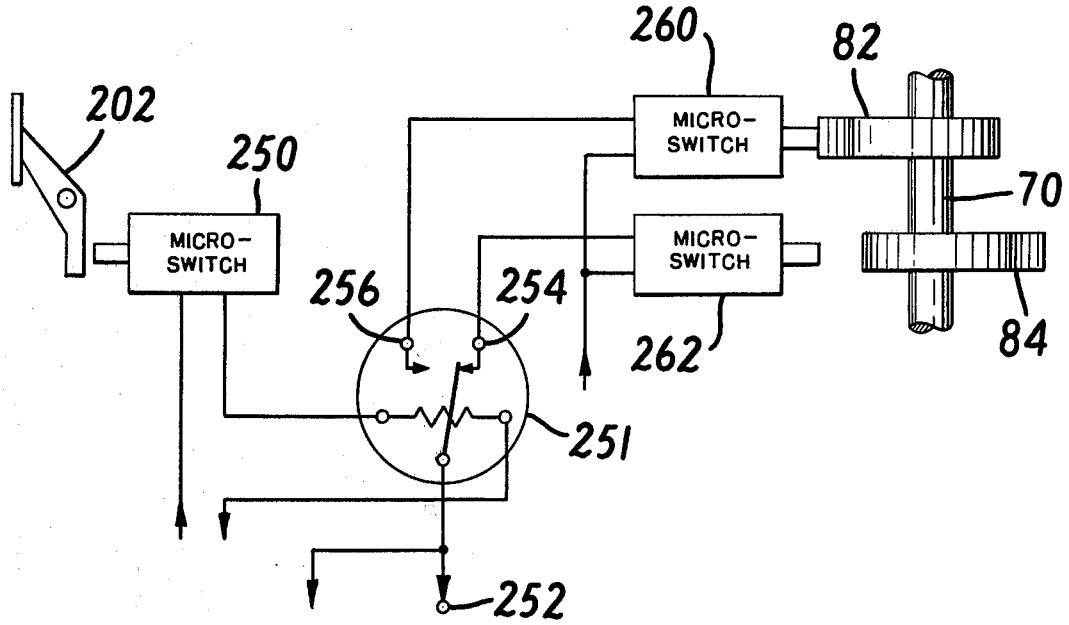
FIG. 17 is a schematic depiction of means to prevent the assembly at the assembly station of sliders without a pull tab, or a spring or both.

FIG. 17 is a schematic representation of means for preventing the assembly of sliders without a pull tab or a spring or body or any combination. A lever 202 is used to sense the presence or absence of, e.g., a pull tab 14 at the assembly station. Under normal conditions the feeder member 96 pushes the pull tab into its holder. Then lever 202 is raised and the microswitch 250 is open. Subsequently the pull tab is assembled to the body and retracted from the assembly station as part of a finished slider. Lever 202 then drops into its holder and the microswitch 250 is closed until the feeder pushes the next pull tab into the pull tab holder and the microswitch again opens. Electric signals are sent to the coil of a relay 251. If the microswitch 250 is open, there is electrical connection between terminals 252 and 254. If the microswitch 250 is closed there is connection between terminals 252 and 256. The signals provided by microswitches 260, 262 activated by cams 82, 84 set approximately 180° apart, and the signal from microswitch 250 is of shorter duration than the dwell or absence of the pull tab in its holder. Under normal condition the timing of the signal from microswitches 260, 262 is set so that the relay 251 does not pass a signal through to stop the apparatus. Two abnormal conditions can develop a) a pull tab is not in the holder when it is supposed to be. The microswitch 250 is closed. The coil in the relay 251 is energized and signal #1 from microswitch 260 passes through and stops the apparatus. This safeguard prevents the apparatus from operating without pull tabs and consequently prevents the assembly of sliders without pull tabs. b) the pull tab is in the holder when it is supposed to be extracted from the nest as a part of a slider. The microswitch 250 is open. The coil in the relay 251 is not energized. Signal #2 from the microswitch 262 passes and stops the machine. This safeguard prevents the machine from operating without slider springs and prevents the assembly of sliders without springs. The machine also stops in absence of bodies because the pull tab is not removed.

Figure 21:
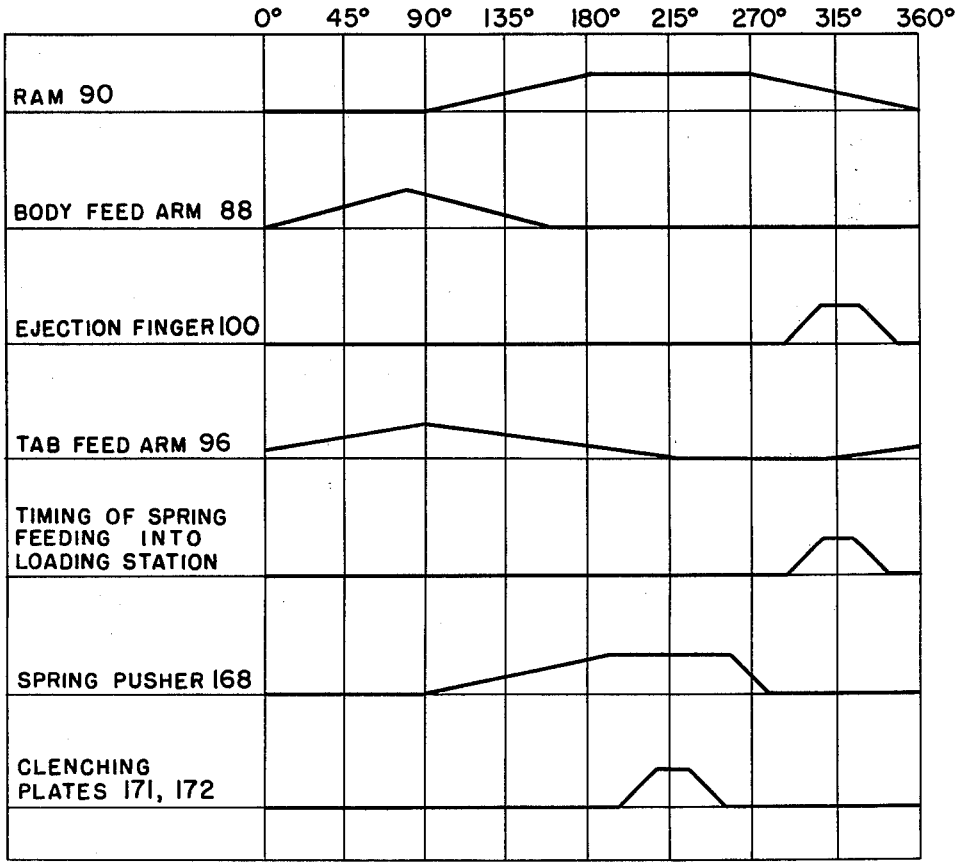
FIG. 21 is a cam timing diagram showing the duration and sequence of operation of various machine components during one revolution of the main drive shaft.

FIG. 21 is a timing diagram depicting one manner of the sequence of operations of the apparatus of the invention for each revolution of main power shaft 59. Thus it will be noted that the cam 76 operating ram 90 dwells for about the first 90° of mainshaft rotation during which feed arm 88 is operated by action of eccentric 150 to load a slider body on the anvil and start its retraction. Similarly the cam operating feed member 96 operates such member to feed a pull tab 14 to its holder. At 90° of rotation of the mainshaft, the ram 90 is started in movement from the loading to assembly station, feed arm 88 and feed member 96 both are retracting and the spring pusher 168 is being moved rightwardly to insert a spring in the body, such last action being completed just after 180° of mainshaft rotation and at which point the ram 90 is stopped at the assembly station, its cam 76 now dwelling for 90°. At about 190° of mainshaft rotation, the cam operating the spring pusher dwells and the clencher cam 66 operates the clenching plates to effect clenching of the slider body lugs. Between 270° and 360° of mainshaft rotation, a new spring is passed by the device shown in FIGS. 15 and 16 as a preliminary to the next cycle of operation, and the ejection finger 100 is operated to remove the assembled slider to collection bin 102.

Figure 22:
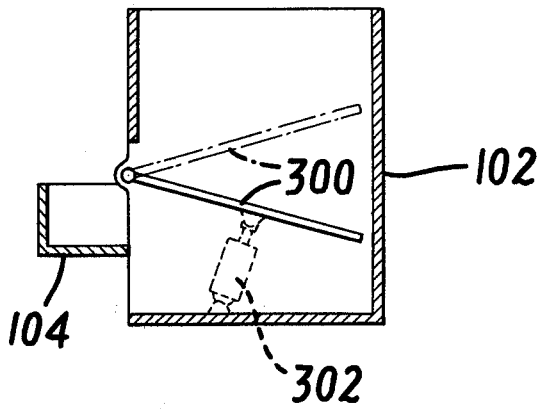
FIG. 22 is an elevational view depicting the collection bins to which finished assembled sliders are delivered and to which defective components can be diverted by selectively positioning a diverter plate in the structure.

FIG. 22 shows the manner in which a diverter member 300 is operated by a piston unit 302 between lower and upper positions in bin 102 for either collecting properly assembled sliders or for diverting for collection in rejects bin 104, defective components, that is, e.g., pull tabs and slider bodies that were present at the assembly station but no spring was present. The operation of the diverter plate is controlled in conjunction with the operation of microswitches and relays described in FIG. 17.

Figure 23:
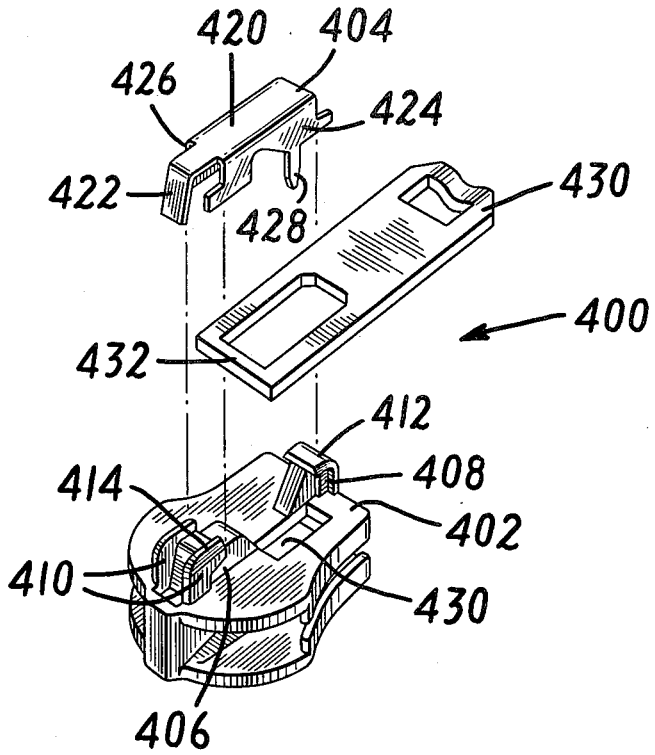
FIG. 23 is an exploded perspective view on enlarged scale of another form of slider which can be assembled with the method and apparatus of the present invention.
Figure 24:
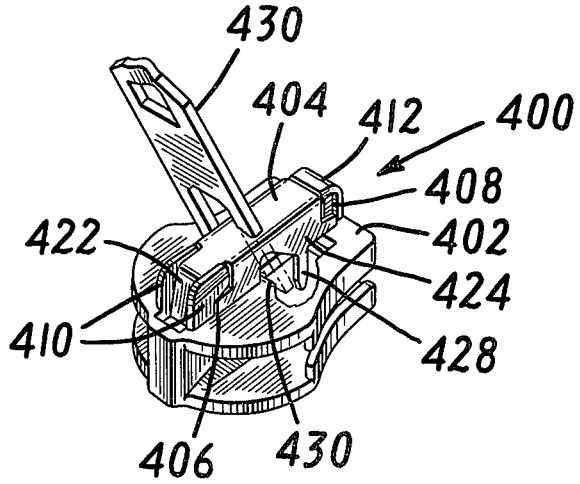
FIG. 24 is a perspective view depicting the slider of FIG. 23 when it has been assembled.

Exemplary of the manner in which the present invention can be employed in the assembling of sliders of a wide range of construction with simple modification of its apparatus and methodology, is its utilization in the assembling of the slider construction 400 shown in FIGS. 22 and 23. With reference to said figures, it will be noted that while the slider body 402 is of construction generally similar to that described earlier, the spring member 404 is not captively connected thereto by clenching the tip end of the body lugs, but rather by reception of the spring in recesses 406, 408 formed at the sides of the body lug means. In such slider body 402, the upper lug means 410 comprises a pair of spaced apart projections and the lower lug means 412 a single frontally extending projection. However, each is provided at the sides with recesses as at 406 and 408. Furthermore, the tip ends of the lug means are chamfered as at 414 to facilitate insertion of the spring 404 over the lug means in the manner to be described shortly. The spring 404 has an elongated main body part 420 which extends between the lug means and is also provided with a tongue-like extension 422 at the upper end thereof provided for the purpose of applying bias to the spring so as to project extension 428 into locking contact with the zipper during normal use of the same, and a pair of wing-like side body parts 424, 426, the wing-like side body parts having edge surfaces complimentally configured with the recesses 406, 408 of the slider body. The spring further includes a rearwardly directed extension 428 which is received in a slotted opening 430 formed in the slider body.

When assembling the slider from the components 402, 404 and 430, the pull tab 430 is received in the slider body between the upper and lower lug means in the same manner as described earlier in connection with the slider shown in FIG. 1 and the spring is then inserted over the trunnion 432 of the pull tab and against the upper and lower lug means. Since the wing-like parts of the spring are of flexibly structured character, the wing side parts spread as they are forced against the lug means and slide downwardly along the side surfaces of the lug means until they locate opposite the recesses 406 and 408 whereupon the flexible character of the spring causes the wing-like parts to retract inwardly into the recesses where they are securely held and thus effect captive connection of the pull tab to the slider body.

The apparatus of the present invention can be used with equal facility for assembling the slider 400. By suitably adjusting the throw of the cams 64 and 66, the spring pusher member 168 can be used to insert the spring over the lug means and force it downwardly until the side wing parts thereof lock in the recesses 406, 408. To facilitate guiding the spring during such pushing movement, the clencher plates 170 and 172 can have their throw adjusted so that they will serve as a guide means for the spring. Thus it will be noted that the apparatus and method of the invention lends itself with highly convenient flexibility to assembly of a range of slider constructions. While the present invention has been described in terms of a preferred form thereof, it will be appreciated that variations in the respective devices can be made and that such system features as, e.g., means for adjusting the throw of the arms of the motion producing means 78, etc., can and are employed in the apparatus.

What is claimed is:

1. Apparatus for assembling lock sliders for slide fasteners, an assembled lock slider being comprised of a slider body having upper and lower pairs of laterally spaced lugs on the front face thereof, a pull tab having a slotted opening therein through which one pair of said body lugs are received, said pull tab further having a trunnion part extending across said body front face between said pairs of lugs, and a spring having a main body part received over said trunnion and extending intermediate the lugs of each said pair, said spring further having a rearwardly directed prong part received through an opening in the slider body, the extremities of said lugs being staked over said spring main body part, said apparatus comprising means comprising a slider body holder including an anvil on which a slider body can be received in upright position with the pairs of lugs facing an assembly station, said means being movable between a first slider body loading position at a loading station and a second position at the assembly station, means for feeding a slider body from a source of such bodies onto said anvil when first-mentioned means is in its first position, means for holding a pull tab in upright position at said assembly station, means for feeding a pull tab from a source of such pull tabs to said pull tab holder, means for holding a spring adjacent said assembly station with the prong part proximate said pull tab, means for feeding a spring from a source thereof to said spring holding means, means for moving said body holder means to its second position in which one pair of the lugs of the slider body mounted on on said anvil are received through the slotted opening in the pull tab in said pull tab holder and said pull tab trunnion is disposed between said upper and lower lug pairs, means engageable with the spring in said spring holding means and operable when said body holder means is in its second position to insert said spring main body part over said pull tab trunnion and between the pairs of lugs on said slider body with the prong part thereof received through the opening in said slider body, clenching means operable upon insertion of said spring main body part between said pairs of lugs for clenching the extremities of said lugs over said spring main body part thereby to fixedly secure said spring and said pull tab to said body, means operable to retract said body holder means from its second position at the assembly station to its first position at the loading station following operation of said clenching means, and means operable during the movement of said body holder means from its second to first positions to remove the assembled slider from said anvil.

2. The apparatus of claim 1 in which the means for moving the body holder means and the spring insertion means move the said respective means in substantially horizontal straight line travel, the spring insertion means retracting from its insertion position at the assembly station following the operation of said clenching means.

3. The apparatus of claim 1 in which the respective sources of slider body, springs and pull tab components each comprise a bin containing a stock of such component and disposed a distance above said loading and assembly station, and a delivery chute connecting the bin with the respective component holding means, the chutes delivering the respective components in an in-line stream of said components to the associated holding means.

4. The apparatus of claim 3 in which the respective bins are provided with vibrator means for vibrating said bins to feed in an oriented flow components therefrom into the respective chutes, each chute being provided with a control device for stopping its associated bin vibration means when the stream of components in said chute is above a predetermined location in said chute and for activating said vibrator means when the stream is below said predetermined location.

5. The apparatus of claim 4 in which each chute is provided with a second control device operable when the stream of components in said chute is below a second lower predetermined location for stopping operation of said apparatus.

6. The apparatus of claim 5 in which the chute associated with said spring is provided with a device at the lower end thereof which is operable to pass only a single spring component to the spring holding means per assembly cycle operation of said apparatus.

7. The apparatus of claim 6 in which said spring passing device includes means for applying an air pulse flow in said chute to facilitate passage of said spring from said passing device to said spring holder.

8. The apparatus of claim 1 in which the slider body feeding means includes a feeder arm and motion producing means connected to said arm, said motion producing means being operable when said body holder means is at said loading station to move said arm in a path as to cause it to engage with the lowermost slider body in a stream of such bodies and seat it on said anvil, said motion producing means further being operable to commence retraction of said arm from the loading station prior to commencement of the movement of said body holder from its first to second positions.

9. The apparatus of claim 1 in which the pull tab feeding means includes a feeder member and motion producing means connected to said member, said motion producing means being operable concurrently with the operation of said slider body feeding means to move said feeder member in a path as to cause it to engage with the lowermost pull tab in a stream of such pull tabs and move it into said pull tab holder at the assembly station, said motion producing means further being operable to commencement of retraction of said member from the assembly station prior to the arrival of the body holder at the assembly station when moved from its first to second positions.

10. The apparatus of claim 9 further comprising means engageable with the second lowermost pull tab in said stream and operable to retain said second lowermost pull tab in said stream during the time said lowermost pull tab is in said pull tab holder.

11. The apparatus of claim 1 in which the means for moving said body holder means between its first and second positions, the means for retracting said body holder means, the spring inserting means and the clenching means are operated in timed relationship from a common power source.

12. The apparatus of claim 11 in which the timed relationship is provided by rotary cam members, and a timing belt operating off said common power source to rotate said rotary cam members.

13. Apparatus in accordance with claim 1 comprising means operable for detecting faulty reception of a slider body on said anvil and for stopping operation of the apparatus upon occurrence of such event.

14. Apparatus in accordance with claim 1 in which said faulty body reception detection means comprises a pair of levers mounted for pivoting movement adjacent said anvil, said levers being positioned such as to lie outside the path of movement of a slider body properly received on said anvil when the body holder means is moved from its first to second positions but to present obstruction to the said movement path when a slider body is improperly received on said anvil, and a switch means for controlling operation of said apparatus, engagement of a slider body improperly received on said anvil with said levers when said holder means moves from its first to second positions causing pivoting of said levers, at least one of said levers being connected with said switch means whereby pivoting movement of said one lever operates said switch means.

15. Apparatus in accordance with claim 1 in which the means for removing an assembled slider from the anvil comprises an ejection finger carried on said body holder means below said anvil, and means for moving said finger upwardly against said anvil and under the assembled slider to eject same from the anvil during the course of the return travel of said body holder means from its second to first positions.

16. Apparatus in accordance with claim 15 in which said ejection finger is carried on a mounting block, said mounting block being supported for pivoting movement on said body holder means, said mounting block being normally disposed to move coaxially with said body holder means during the movement of said body holder means from its second to first positions, and a stop abutment presenting an obstruction to the said co-axial movement of said mounting block during return of the body holder means to its first position whereby said mounting block is caused to pivot and correspondingly move said ejection finger in an upward direction until said mounting block moves beyond said obstruction.

17. The apparatus of claim 16 in which said stop abutment is supported for uni-directional rotation about a fixed axis, said stop abutment being rotated out of its stop abutment position and out of the movement path of said mounting block by engagement therewith of said mounting block when said body holder means moves from its first to second positions, there being bias means connected with said stop abutment to return it to its abutment position when said body holder means is in its second position.

18. Apparatus in accordance with claim 14 comprising means for facilitating removal from said anvil of slider bodies improperly received thereon.

19. Apparatus in accordance with claim 18 wherein said slider body removal means comprises a lever operated mechanism engageable with said pair of levers for swinging same to provide access to the anvil for effecting removal of an improperly received slider body therefrom.

20. Apparatus in accordance with claim 1 in which said clenching means comprises a pair of clenching plates arranged in side by side aligned and spaced apart disposition and unitarily moveable against the extremities of said slider body lugs to effect clenching of same.

21. Apparatus in accordance with claim 20 in which the juxtaposed corners of said clenching plates at one end thereof are provided with chamfered surfaces to facilitate clenching engagement of said plates with said lugs.

22. Apparatus in accordance with claim 21 in which said clenching plates engaged guide surfaces during clenching travel thereof to prevent lateral spread of said clenching plates.

23. Apparatus in accordance with claim 20 in which the spring insertion means comprises an elongated slide having a spring engagement surface at one end thereof, said spring engagement end being configured conformedly to the shape of said spring main body part.

24. Apparatus in accordance with claim 23 in which the spring main body part is of elongated shape and is provided with wing tabs extending laterally at each side of said main body part, said slider one end having companionally configured wing tab segments.

25. Apparatus in accordance with claim 24 in which said slider is disposed between said clenching plates, said clenching plates having elongated slotted grooves in which the slider wing tab segments travel during movement of said slider.

26. Apparatus in accordance with claim 25 in which the clenching plates at said one end thereof is provided with widened slotted portions which provide clearance regions in said clenching plates for reception of the wing tab segments of said spring insertion slide during the time said clenching plates are in clenching engagement with said body lugs.

27. The apparatus of claim 2 comprising means for detecting the absence of a slider component at the assembly station and operable to cause shut down of the apparatus upon detecting the absence of such component.

28. The apparatus of claim 1 further comprising means for detecting the faulty mounting of a slider body on said anvil, and for causing shutting down of the apparatus, means for removing said faultily mounted body from said anvil, second detection means for detecting the absence of springs and pull tabs at the assembly station and operable to cause shut down of the apparatus, and respective collection sources to which are assembled slider and the individual slider components present on the anvil and at the assembly station when the absence and faulty mounting of one is detected can be conveyed.

29. The apparatus of claim 28 in which said collection sources comprise an assembled slider collection bin, and a rejects components collection bin.

30. The apparatus of claim 29 in which said rejects collection bin is disposed adjacent said assembled slider collection bin, said last-mentioned bin having a diverter member mounted therein and selectively positionable between a first position associated with collection of assembled sliders in such bin to a second position in which the diverter diverts components entering said second mentioned bin through an opening connecting it with said rejects collection bin.

31. Apparatus in accordance with claim 1 further comprising deflector means for deflecting the ejection course assembled sliders traverse when removed from said anvil by said ejection finger.

32. A method for assembling lock sliders for slide fasteners, as assembled lock slider being comprised of a slider body having upper and lower pairs of laterally spaced lugs on the front face thereof, a pull tab having a slotted opening therein through which one pair of said body lugs are received, said pull tab further having a trunnion part extending across said body front face between said pairs of lugs, and a spring having a main body part received over said trunnion and extending intermediate the lugs of each said pair, said spring further having a rearwardly directed prong part received through an opening in the slider body, the extremities of said lugs being staked over said spring main body part, said method comprising feeding a spring and a pull tab to an assembly station from respective in-line stock sources thereof, positioning said spring and said pull tab in upright disposition at said assembly station with the spring located to one side of said pull tab, feeding a slider body from an in-line stock source of such bodies to a loading station located at and spaced from the other side of said pull tab and receiving said body on an anvil at said loading station, moving said anvil from its position at the loading station to a position at the assembly station in which said one pair of lugs on the body extends through the slotted opening in the pull tab and the trunnion pull tab locates between the upper and lower pairs of lugs, and holding said anvil at said moved position thereof, then inserting said spring main body part over said pull tab trunnion and between the pairs of lugs on said body with the prong part thereof received through the opening in said slider body, applying a force to the extremities of said lugs to clench them over said spring main body part, returning said anvil to said loading station, and removing the assembled slider from said anvil while it is being returned to said loading station.

33. The method of claim 32 in which the anvil is moved from the body loading to assembly stations in a substantially horizontal straight line travel course, the spring being inserted in the body and the clenching force being applied in like horizontal straight line courses.

34. The method of claim 32 comprising monitoring the presence of slider components at the assembly station, and terminating the assembly operation when a component is absent from the assembly station.

35. The method of claim 32 comprising detecting the improper mounting of a slider body on said anvil and terminating the assembly operation when such condition is detected.

36. Apparatus for assembling lock sliders for slide fasteners, an assembled lock slider being comprised of a slider body having upper and lower lug means on the front thereof, a pull tab having a slotted opening therein through which one lugs means is received, said pull tab further having a trunnion part extending across said body front face between said upper and lower lug means, and a spring having a main body part received over said trunnion and extending between said upper and lower lug means and engaged in captive connection with said lug means, said spring further having a rearwardly directed prong part received through an opening in the slider body, said apparatus comprising means comprising a slider body holder including an anvil on which a slider body can be received in upright position with the upper and lower lug means facing an assembly station, said means being movable between a first slider body loading position at a loading station and a second position at the assembly station, means for feeding a slider body from a source of such bodies onto said anvil when first-mentioned means is in its first position, means for holding a pull tab in upright position at said assembly station, means for feeding a pull tab from a source of such pull tabs to said pull tab holder, means for holding a spring adjacent said assembly station with the prong part proximate said pull tab, means for feeding a spring from a source thereof to said spring holding means, means for moving said body holder means to its second position in which one of the lug means of the slider body mounted on said anvil is received through the slotted opening in the pull tab in said pull tab holder and said pull tab trunnion is disposed between said upper and lower lug means, means operable when said body holder means is in its second position for inserting said spring main body part over said pull tab trunnion and between the lug means on said slider body with the prong part thereof received through the opening in said slider body and for captively connecting said spring with said lug means, means operable to retract said body holder means from its second position at the assembly station to its first position at the loading station following operation of the last-mentioned means, and means operable during the movement of said body holder means from its second to first positions to remove the assembled slider from said anvil.

37. The apparatus of claim 36 in which the lug means have recess-containing outer side surfaces, the spring main body part including wing-like rearwardly directed flanges which are sufficiently flexible to spread in opposite direction and ride over said lug means and located in said recesses to captively connect said spring to said lug means, the means for inserting said spring main body part including a sliding pusher member engageable with said spring to push it over said lug means, and guide means operable to guide the spring during the course of its insertion over said lug means.

38. A method for assembling lock sliders for slider fasteners, an assembled lock slider being comprised of a slider body having upper and lower lug means on the front face thereof, a pull tab having a slotted opening therein through which one lug means is received, said pull tab further having a trunnion part extending across said body front face between said upper and lower lug means, and a spring having a main body part received over said trunnion and extending between said upper and lower lug means and engaged in captive connection with said lug means, said spring further having a rearwardly directed prong part received through an opening in the slider body, said method comprising feeding a spring and a pull tab to an assembly station from respective in-line stock sources thereof, positioning said spring and said pull tab in upright disposition at said assembly station with the spring located to one side of said pull tab, feeding a slider body from an in-line stock source of such bodies to a loading station located at and spaced from the other side of said pull tab and receiving said body on an anvil at said loading station, moving said anvil from its position at the loading station to a position at the assembly station in which one of the lug means on the body extends through the slotted opening in the pull tab and the trunnion pull tab locates between the upper and lower pairs of lugs, and holding said anvil at said moved position thereof, then inserting said spring main body part over said pull tab trunnion and between the lug means on said body with the prong part thereof received through the opening in said slider body and captively connecting said spring with said lug means, returning said anvil to said loading station, and removing the assembled slider from said anvil while it is being returned to said loading station.

39. The method of claim 38 in which the lug means have recess containing outer side surfaces, the spring main body part including wing-like rearwardly directed flanges which are sufficiently flexible to spread in opposite directions and ride over said lug means and locate in said recesses to captively connect said spring to said lug means.

* * * * *